United States Patent [19]

Shoji et al.

[11] Patent Number: 4,692,735

[45] Date of Patent: Sep. 8, 1987

[54] NONLINEAR VOLTAGE DEPENDENT RESISTOR AND METHOD FOR MANUFACTURING THEREOF

[75] Inventors: Moritaka Shoji; Takeo Yamazaki; Satoru Ogihara, all of Hitachi, Japan

[73] Assignee: Hitachi, Ltd., Tokyo, Japan

[21] Appl. No.: 725,584

[22] Filed: Apr. 22, 1985

[30] Foreign Application Priority Data

Apr. 25, 1984 [JP] Japan ..... 59-81831

[51] Int. Cl.[4] ..... H01C 7/10

[52] U.S. Cl. ..... 338/21; 29/610 R; 252/518; 338/20; 427/101; 427/103

[58] Field of Search ..... 338/21, 20, 277, 308, 338/314; 252/521, 518, 520; 29/610 R, 620, 621; 427/101, 103

[56] References Cited

U.S. PATENT DOCUMENTS

| | | | |
|---|---|---|---|
| 3,760,318 | 9/1973 | Masuyama et al. | 338/20 |
| 3,975,307 | 8/1976 | Matsuo et al. | 252/521 X |
| 4,031,498 | 6/1977 | Hayashi et al. | 338/21 |
| 4,326,187 | 4/1982 | Miyoshi et al. | 338/21 |
| 4,374,160 | 2/1983 | Yoshioka et al. | 427/101 |
| 4,409,728 | 10/1983 | Ellis et al. | 427/101 X |
| 4,495,482 | 1/1985 | Philipp | 338/21 |

*Primary Examiner*—A. T. Grimley
*Assistant Examiner*—Jane K. Lau
*Attorney, Agent, or Firm*—Antonelli, Terry & Wands

[57] ABSTRACT

A paste composed of $Li_2CO_3$, $SiO_2$, $Sb_2O_3$ and $Bi_2O_3$ is coated and baked on a side surface of a sintered ZnO based nonlinear voltage dependent resistor body to form a high resistance side surface for improving a impulse current withstand of the resistor.

The amount of the paste constituent is 1~2.5 mol % for $Li_2CO_3$, 72±5 mol % for $SiO_2$, 20±3 mol % for $Sb_2O_3$ and 8±2 mol % for $Bi_2O_3$.

5 Claims, 4 Drawing Figures

NONLINEAR VOLTAGE DEPENDENT RESISTOR AND METHOD FOR MANUFACTURING THEREOF

BACKGROUND OF THE INVENTION

The present invention relates to a zinc oxide-based nonlinear voltage dependent resistor for lightning arrestors and to a method for manufacturing thereof, and more particularly relates to a nonlinear voltage dependent resistor with a high impulse current withstand property and a method for manufacturing thereof.

A zinc oxide-based nonlinear voltage dependent resistor is produced through a well-known ceramic sintering technique. Starting materials including zinc oxide (ZnO) powder as the main component, bismuth oxide ($Bi_2O_3$), antimony oxide ($Sb_2O_3$), cobalt oxide ($Co_2O_3$), manganese oxide ($MnO_2$), chromium oxide ($Cr_2O_3$), silicon oxide ($SiO_2$), boron oxide ($B_2O_3$), and aluminum oxide ($Al_2O_3$) are well mixed with each other. After adding a suitable binder such as water or polyvinyl alcohol to the mixture, the resulting mixture is granulated, and the granules are molded. The obtained molding is fired or sintered at high temperatures. In order to prevent flashover, an inorganic paste comprising a mixture of a $SiO_2$-$Sb_2O_3$-$Bi_2O_3$ ternary component and an organic binder is coated to the sides of the sintered body, dried and baked in an electric furnace at a temperature of 800 to 1,500° C., thus high resistance side layer is formed around the sintered body, as disclosed for example in Japanese Pat. Publication No. 53-21516 published on Jul. 3, 1978. Each of the upper and lower ends of the nonlinear voltage dependent resistor thus produced is ground to obtain a desired thickness and electrodes are formed on these ends by metal spraying or baking to form a product. In order to increase the impulse current withstand property, or in other words flashover withstand ability, of the nonlinear voltage dependent resistor, the thickness of the high resistance side layers has to be increased, however, which causes interfacial cracking or peeling of the high-resistance side layers from the nonlinear voltage dependent resistor body during the baking process due to the difference of thermal expansion coefficients between the body and the high-resistance side layers, so that a flashover is apt to occur even at a relatively low impulse current applied.

A method for forming a high-resistance side layer by diffusing lithium or its compound is also known as disclosed for example in Japanese Pat. Publication No. 5221714 published on Jun. 13, 1977. However, this method has drawbacks that a control of the thickness of the high-resistance side layer is difficult, since lithium ions are diffused among zinc oxide crystal grains and that the lithium ions are diffused into the inside of the element, the nonlinear voltage dependent resistor body, to damage its nonlinearity when the element is used for a long period of time.

OBJECT AND SUMMARY OF THE INVENTION

It is an object of the present invention to provide a zinc oxide-based nonlinear voltage dependent resistor for arrestors, having a high impulse current withstand property or in other words a high resistance to flashover thus preventing thermal shock fracture of the resistor, and a method for manufacturing thereof.

The present invention provides a nonlinear voltage dependent resistor having high-resistance layers formed on the sides thereof by applying a paste prepared by mixing an organic binder with $SiO_2$-$Sb_2O_3$-$Bi_2O_3$-$Li_2CO_3$ powders to the sides of a nonlinear voltage dependent resistor body, drying and baking the paste at high temperatures to the body.

The amount of composition of the $Li_2CO_3$-containing $SiO_2$-$SbO_3$-$Bi_2O_3$paste used in the present invention is selected from an amount within the region enclosed by following four composition points in a ternary system diagram of $SiO_2$, $Sb_2O_3$ and $Bi_2O_3$: composition point 1; ($SiO_2$=95 mol %, $Sb_2O_3$=5 mol %, $Bi_2O_3$=0 mol %), composition point 2; ($SiO_2$=50 mol %, $Sb_2O_3$=50 mol %, $Bi_2O_3$=0 mol %), composition point 3; ($SiO_2$=50 mol %, $Sb_2O_3$=30 mol %, $Bi_2O_3$=20 mol %), and composition point 4; ($SiO_2$=75 mol %, $Sb_2O_3$=5 mol %, $Bi_2O_3$32 20 mol %), and an amount of $Li_2CO_3$from 0.1 to 10 mol %.

The most preferrable amount of the paste composition of the present invention is to be;

$SiO_2$ : 72±5 mol %, $Sb_2O_3$ : 20±3 mol %, $Bi_2O_3$ : 8±2 mol %, and $Li_2CO_3$ : 1~2.5 mol %.

The above inorganic powder is kneaded with an organic binder to form a paste. The organic binder is prepared by dissolving ethylcellulose in Triclene or Butylcarbitol.

The nonlinear voltage dependent resistor of the present invention is prepared by uniformly applying the above paste to the sides of the ZnO-based sintered body, drying it in a dryer heated to a temperature of 100 to 150° C. and baking it at 1,000 to 1,300° C.

The thickness of the applied inorganic paste layer is preferably about 0.2 to 2 mm.

When applying the inorganic paste of the present invention by coating, its amount or the thickness is freely adjustable by changing its viscosity. The coating also is performed by spraying. When the inorganic paste is applied to the sides of the sintered body and, after drying, baked at high temperatures, a solid-solid reaction, a solid-liquid reaction of $Sb_2O_3$ and $Bi_2O_3$ having low-melting points with ZnO crystal grains, and liquid-liquid reaction of $Sb_2O_3$ and ZnO having low melting points with $Bi_2O_3$ in the sintered body occurs at the interface between the paste and the body, and especially $Bi_2O_3$ which functions as a flux, itself forms the high-resistance side layer and at the same time binds firmly the high resistance side layer with the sintered body.

$SiO_2$-$Sb_2O_3$-$Bi_2O_3$ in the paste reacts with ZnO in the body to form a first high resistance side layer. The lithium in the paste is diffused deeply into ZnO crystal grains in the body during baking to form a second high resistance side layer. The first and second high resistance side layers in combination increase the thickness of the high resistance side layer, thereby enhance the impulse current withstand property of the nonlinear voltage dependent resistor of the present invention.

The amount of the lithium carbonate contained in the inorganic paste of the present invention is preferably 0.1 to 10 mol %. When it is below 0.1 mol %, the impulse current withstand is not improved. On the other hand, when it exceeds 10 mol %, the impulse current withstand property saturates, but instead the thickness of the high resistance side layer unnecessarily increases, and thus restricts the current flowing passage of the nonlinear voltage dependent resistor.

The baking temperature of the inorganic paste is preferably 1,000 to 1,300° C. When it is below 1,000° C., the baking is effected unsatisfactorily, while when it is above 1,300° C., the lithium is diffused unnecessarily deep into the inside of the sintered body and besides bismuth oxide and antimony oxide are vaporized, which is not desirable.

The high-resistance side layer contains ZnO and which forms a multi-component composition with the applied inorganic paste components of $SiO_2$, $Sb_2O_3$, $Bi_2O_3$, and $Li_2CO_3$. The thickness of the high resistance side layer is preferably 3 μm to 2 mm. When it is below 3 μm, the layer becomes nonuniform, while when it exceeds 2 mm, the layer restricts the current flowing passage, or in other words enlarges the outside diameter of the nonlinear voltage dependent resistor in vain, which is not desirable, though no adverse effect on the impulse current withstand property is recognized. Each of the above components has a concentration gradient along a depth from the periphery. The concentrations of Si, Sb, Bi, and Li are higher at the portion near to the periphery and, on the contrary, that of Zn is higher at the portion remote to the periphery of the sintered body. The desirable composition of the high-resistance side layer is expressed as an average composition of the portion from the periphery of the layer to a depth of 200 μm to be as;

Si: 5 to 70 mol % (in terms of $SiO_2$)
Sb: 2 to 30 mol % (in terms of $Sb_2O_3$)
Bi: 2 to 10 mol % (in terms of $Bi_2O_3$)
Li: 0.01 to 5 mol % (in terms of $Li_2CO_3$)
Zn: 10 to 90 mol % (in terms of ZnO).

A trace of Co. Mn, and Cr is detected in the portion, because these components in the nonlinear voltage dependent resistance body are diffused into the layer during baking.

Because of its function as a flux, $Bi_2O_3$ is presumed to accelerate the diffusion of $SiO_2$ or $Sb_2O_3$ or the reaction with zinc oxide, and part of it forms a composite compound with ZnO to provide a high-resistance side layer.

The Li forms a composite compounds with each of the oxides of Zn, Si, Sb, and Bi to provide a high-resistance side layer. Furthermore, part of the Li is diffused into ZnO crystal grains in the sintered body to form the second high-resistance side layer with an order of $10^{2\frac{3}{8}}$-cm, thereby increasing the impulse current withstand property of the nonlinear voltage dependent resistor. The Sb and Si form a high-resistance side layer of composite compounds, $Zn_7Sb_2O_{12}$ and $Zn_2SiO_4$, respectively, together with the Zn.

DESCRIPTION OF THE PREFERRED EMBODIMENT

Examples of the present invention will now be given.

[Example 1]

The following main component and additives were accurately weighed and wet-blended together for 12 hours in a ball mill:

main component: 7,630 g of zinc oxide.

additives: 325 g of bismuth oxide ($Bi_2O_3$), 166 g of cobalt oxide ($Co_2O_3$), 57 g of manganese oxide (MnO), 292 g of antimony oxide ($Sb_2O_3$), 76 g of chromium oxide ($Cr_2O_3$), 90 g of silicon oxide ($SiO_2$), and 1.5 g of aluminum nitrate [$Al(NO_3)_2.9H_2O$].

The obtained powder mixture was dried, granulated, and formed into a molding of 58 mm $\phi \times 27$ mm t body. This molding was baked at a temperature of 1,200° C. for 2 hours.

The composition of an inorganic paste separately prepared was as follows: 50 wt. % of Tri-Clene, 3 wt. % of ethylcellulose, and 47 wt. % of an inorganic powder. The composition of the inorganic powder was as follows: 60 mol % of $SiO_2$, 30 mol % of $Sb_2O_3$, 10 mol % of $Bi_2O_3$, and 1 mol % of $Li_2CO_3$. In the preparation, ethylcellulose was added to Triclene at 50 to 60° C., which was then placed in an ultrasonic cleaning tank for about 20 minutes to dissolve the ethylcellulose completely. The above fully mixed inorganic powder was thrown into the solution, and the mixture was kneaded by means of an attritor. The obtained paste was uniformly applied to the sides of the above sintered body and dried. The sintered body to which the inorganic paste was applied was baked at 1,050° C. for 2 hours. The upper and lower ends of the body were ground to a depth of about 0.5 mm by means of a lap master, cleaned and provided with thermally sprayed Al electrodes. The final size of the body was 50.2 mm$\phi \times$24.0 mmt. The varistor voltage VlmA was measured by providing silver electrodes having a diameter of 1 mm at a given distance on each of the upper and lower ends for obtaining partial resistivity of the resistor, and it was revealed that the thickness of the high-resistance side layer of this example was 0.7 mm.

Figure 1:
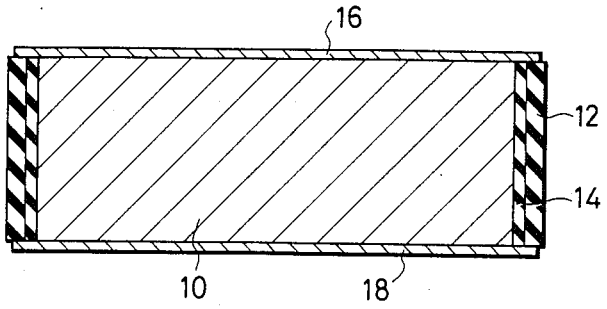
FIG. 1 is a cross-sectional view of a nonlinear voltage dependent resistor of the present invention.
Figure 2:
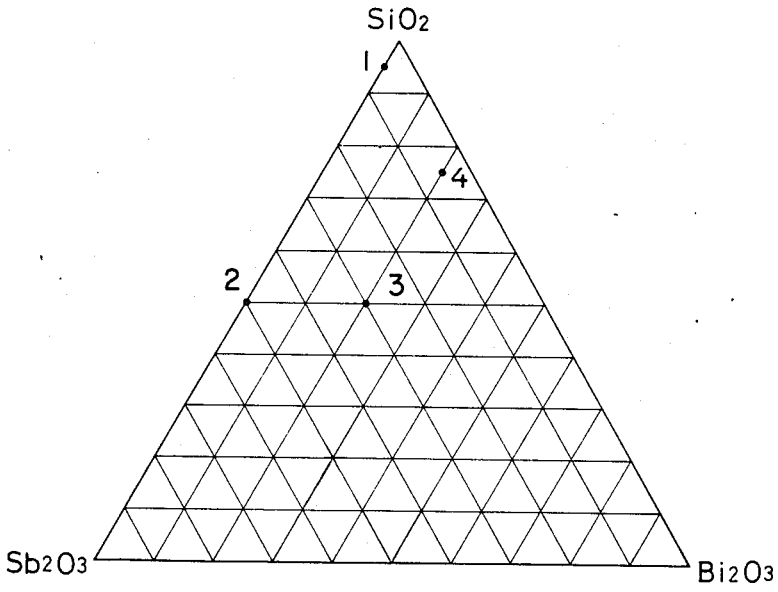
FIG. 2 is a ternary system diagram of $SiO_2$, $Sb_2O_3$ and $Bi_2O_3$ which are contained in the inorganic paste together with $Li_2CO_3$ forming the high resistance side layer for the nonlinear voltage dependent resistor of the present invention.

The FIG. 1 shows a nonlinear voltage dependent resistor produced in accordance with this Example 1, first and second high resistance side layers 12, and 13 are formed around the side surface of the cylindrical nonlinear voltage dependent resistance body 10. The first layer 12 was substantially formed of reaction products of ZnO with $SiO_2$-$Sb_2O_3$-$Bi_2O_3$ of an order of resistivity $10^{12\frac{3}{8}}$-cm, the second layer 14 was substantially formed by diffusion of the lithium into the ZnO crystal grains in the body of an order of resistivity $10^{2\frac{3}{8}}$-cm. The electrodes 16 and 18 are formed on the upper and lower ends of the body 10.

Table 1 shows the results of a impulse current withstand test on the nonlinear voltage dependent resistor * having a conventional high-resistance $SiO_2$-$Sb_2O_3$-$Bi_2O_3$ side layer without lithium carbonate. The occurrence of flashover in other words breakdown of a sample was tested, when a impulse current of 8×20 μs (4×10 μs in a case of 40 kA or above) was applied through the sample twice. In this Table, mark O represents "normal" and mark X represents "breakdown". While the conventional sample was broken at 50 kA, the sample of the present invention remained normal up to 80 kA. *thus produced and a nonlinear voltage dependent resistor

TABLE 1

| | Impulse current (kA) | | | | | | | |
|---|---|---|---|---|---|---|---|---|
| | 20 | 30 | 40 | 50 | 60 | 70 | 80 | 90 |
| Sample of | O | O | O | O | O | O | O | X |
| the invention | O | O | O. | O | O | O | O | |
| Conventional | O | O | O | X | | | | |
| sample | O | O | O | | | | | |

[EXAMPLE 2]

Figure 3:
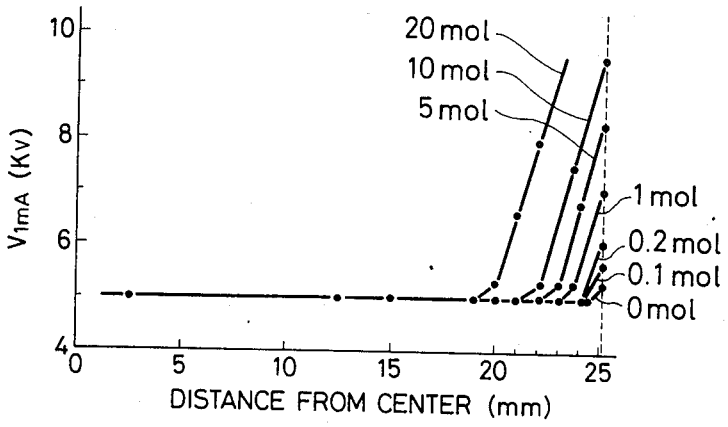
FIG. 3 is a diagram showing varistor voltage distributions inside the nonlinear voltage dependent resistors of several lithium carbonate contents including embodiments of the present invention.

Lithium carbonate in an amount given in Table 2 was added to a composition comprising 60 mol % of $SiO_2$, 30 mol % of $Sb_2O_3$, and 10 mol % of $Bi_2O_3$, and the resulting mixture was applied to the sides of the same sintered body as used in Example 1 to form a high-resistance layer. Each of the upper and lower ends was ground by means of a lap master and cleaned. Silver electrodes of a diameter of 1 mm were formed at a distance of 1 mm along a line from the center to the side, and the voltage-current characteristics at each point were measured. FIG. 3 shows the distribution of varistor voltage VlmA. When $Li_2CO_3$is O, the VlmA increases slightly at a portion of 0.5 mm inside from the periphery. Although not clear from the figure, up to 0.2 mm thick a high resistance side layer of $SiO_2$-$Sb_2O_3$-$Bi_2O_3$-ZnO was detected to be formed.

On the contrary, the VlmA increases when $Li_2CO_3$ is added. When $Li_2CO_3$ is 1 mol %, the VlmA at a portion of 0.3 mm inside was 7 kV, which is 1.4 times that (5 kV) of the center. The thickness of the high resistance side layer of this sample was 1 mm.

The dotted line in FIG. 3 indicates the periphery of the nonlinear voltage dependent resistor of the present example.

Table 2 shows the impulse withstand and the formed high resistance side layer of each sample. The impulse withstand represents a current value at which a sample operates normally when the current is applied. When $Li_2CO_3$ is 0.1 to 20 mol %, the current impulse withstand is 50 to 80 kA, which is greater than that (40 kA) of a case of $Li_2CO_3$ is 0 mol %. When, however, $Li_2CO_3$ is 20 mol %, the high-resistance side layer grows too thick due to active diffusion of lithium, which is not desirable. A case where $Li_2CO_3$ is 1 mol % is suitable for practical purpose.

TABLE 2

| | $Li_2CO_3$ (mol %) | Impulse current withstand (kA) | Thickness high resistance side layer (mm) |
|---|---|---|---|
| a | 0 | 40 | 0.2 |
| b | 0.1 | 50 | 0.3 |
| c | 0.2 | 70 | 0.4 |
| d | 0.5 | 80 | 0.5 |
| e | 1 | 80 | 0.7 |
| f | 5 | 80 | 1.5 |
| g | 10 | 80 | 2.0 |
| h | 20 | 60 | 4.5 |

[EXAMPLE 3]

17 compositions of inorganic pastes of $SiO_2$, $Sb_2O_3$, $Bi_2O_3$, and $Li_2CO_3$ shown in Table 3 were prepared. Each paste was applied on the sides of the same sintered body by baking in the same manner as in Example 1 to form a high-resistance side layer thereon. Table 3 shows the results of analysis of Si, Sb, Bi, and Zn with an X-ray microanalyzer and those of Li by a chemical analysis. Because Li can not be detected with an X-ray microanalyzer, the results are those of a portion from the edge surface to a depth of 200 μm determined by a chemical analysis.

Figure 4:
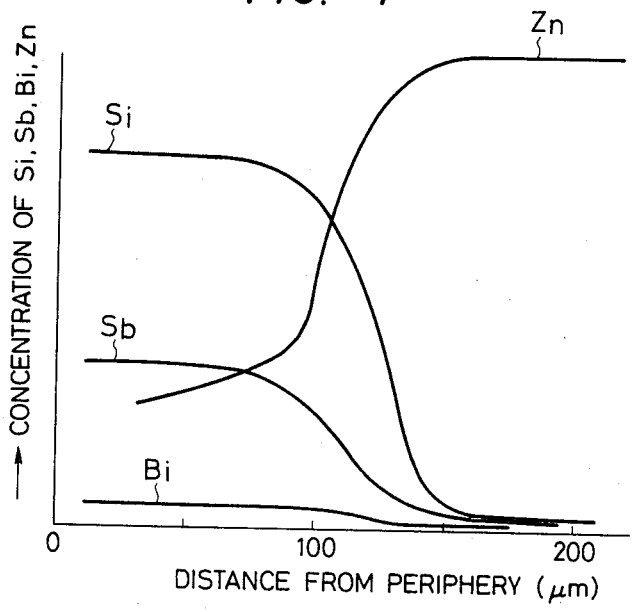
FIG. 4 is a diagram showing the concentration of zinc oxide, silicon oxide, antimony oxide and bismuth oxide near the periphery of one embodiment of the nonlinear voltage dependent resistor of the present invention.

FIG. 4 shows the results of analysis of Si, Sb, Bi, and Zn near the edge of sample k with an X-ray microanalyzer. The concentrations of the three elements, Si, Sb, and Bi, are higher near the surface and sharply decrease at a depth of about 100 μm from the edge surface. Although the role of $Bi_2O_3$ is presumed to be a function as a flux and it accelerates the diffusion of $SiO_2$ and $Sb_2O_3$ or the reaction with ZnO, its concentration on the surface is high and constitutes a component of a high-resistance side layer. On the other hand, Zn is detected within a portion shallower than 100 μm and diffuses to form a high-resistance side layer together with Si, Sb, Bi, and Li.

The current impulse withstands of samples j to m, o, p, s, t, and w to y are sufficiently high, so that they are desirable as high-resistance side layers. However, sample m has a low square-wave current withstand which was measured separately, and sample y has a low nonlinearity coefficient α, both samples m and y are not desirable.

TABLE 3

| | Composite amounts (mol %) | | | | Results of analysis (mol %) | | | | | Impulse current withstand |
|---|---|---|---|---|---|---|---|---|---|---|
| | $Li_2CO_3$ | $SiO_2$ | $Sb_2O_3$ | $Bi_2O_3$ | $Li_2CO_3$ | $SiO_2$ | $Sb_2O_3$ | $Bi_2O_3$ | ZnO | (kA) |
| i | 0 | 70 | 25 | 5 | 0 | 34.5 | 12.9 | 3.9 | 48.7 | 40 |
| j | 0.1 | 70 | 25 | 5 | 0.03 | 26.3 | 15.3 | 3.0 | 55.4 | 50 |
| k | 1 | 70 | 25 | 5 | 0.41 | 31.9 | 13.2 | 3.2 | 51.3 | 80 |
| l | 9 | 64 | 23 | 4 | 3.5 | 35.5 | 11.2 | 3.1 | 46.7 | 70 |
| m | 33 | 47 | 17 | 3 | 11.3 | 19.9 | 12.3 | 3.5 | 53.0 | 70 |
| n | 1 | 100 | 0 | 0 | 0.32 | 36.0 | 0.8 | 0.3 | 63.7 | 30 |
| o | 1 | 80 | 15 | 5 | 0.28 | 41.9 | 7.5 | 3.8 | 46.5 | 90 |
| p | 1 | 60 | 30 | 10 | 0.29 | 31.2 | 12.1 | 4.9 | 51.5 | 80 |
| q | 1 | 40 | 45 | 15 | 0.35 | 17.5 | 21.0 | 5.4 | 55.8 | 50 |
| r | 1 | 90 | 0 | 10 | 0.35 | 44.8 | 0.7 | 5.4 | 49.5 | 40 |
| s | 1 | 80 | 10 | 10 | 0.29 | 39.3 | 4.9 | 4.2 | 51.3 | 80 |
| t | 1 | 55 | 40 | 5 | 0.41 | 23.3 | 17.6 | 3.1 | 55.6 | 70 |
| u | 1 | 25 | 70 | 5 | 0.45 | 11.6 | 40.8 | 3.7 | 43.5 | 40 |
| v | 1 | 90 | 10 | 0 | 0.35 | 34.1 | 4.6 | 0.2 | 61.3 | 50 |
| w | 1 | 70 | 20 | 10 | 0.31 | 32.5 | 11.0 | 3.5 | 52.7 | 90 |
| x | 1 | 70 | 10 | 20 | 0.51 | 32.5 | 16.5 | 6.0 | 44.5 | 70 |
| y | 1 | 60 | 10 | 30 | 0.23 | 25.0 | 12.4 | 13.1 | 49.3 | 60 |

[EXAMPLE 4]

The granules prepared in Examples 1 were formed into a molding of 57 mmϕ×26 mmt. In order to effect the preliminary shrinkage of the molding, it was fired or presintered at a temperature of 1,050° C. for 2 hours. The dimensions of the sintered bodies were 50 mmϕ×23 mmt and the shrinkage was 13 %.

Each of the inorganic pastes containing 0 to 20 mol % of $Li_2CO_3$ was uniformly applied to the edge of the above sintered body and, after drying, baked and sintered at 1,250° C. for 2 hours. The inorganic pastes further contained 60 mol % of silicon oxide ($SiO_2$), 30 mol % of antimony oxide ($Sb_2O_3$), and 10 mol % of bismuth oxide ($Bi_2O_3$) as same as

EXAMPLE 2

The impulse current withstand properties of the respective samples were same or even better than those corresponding to the samples of Example 2.

As mentioned above, the zinc oxide-based nonlinear voltage dependent resistor of the present invention is freed from flashover at relatively high impulse current which is often observed in conventional voltage-nonlinear resistors. More precisely, the nonlinear voltage dependent resistor of the present invention has a impulse current withstand approximately twice as high as that of a conventional resistor.

We claim:

1. A nonlinear voltage dependent resistor comprising a zinc oxide (ZnO) based sintered body constituting a current flowing passage having high-resistance layer formed on the side thereof and electrodes (18) formed on the upper and lower ends thereof characterized in that said high-resistance side layer contains silicon, antimony, bismuth, and lithium, the average composition of the portion from the side surface to a depth of 200 μm being 5 to 70 mol % of silicon (in terms of $SiO_2$), 2 to 30 mol % of antimony (in terms of $Sb_2O_3$), 2 to 10 mol % of bismuth (in terms of $Bi_2O_3$), 0.01 to 5 mol % of lithium (in terms of $Li_2CO_3$), and 10 to 90 mol % of zinc (in terms of ZnO).

2. A nonlinear voltage dependent resistor according to claim 1 wherein said high resistance side layer is constituted by a first resistance side layer which is formed near the surface and a second resistance side layer which is formed next to the first resistance side layer and has a lower resistivity than that of the first resistance side layer.

3. A method for manufacturing a nonlinear voltage dependent resistor comprises, a step of mixing a predetermined amount of powder of zinc oxide (ZnO), bismuth oxide ($Bi_2O_3$), antimony oxide ($Sb_2O_3$), cobalt oxide ($CO_2O_3$), manganese oxide ($MnO_2$), chromium oxide ($Cr_2O_3$), silicon oxide ($SiO_2$), boron oxide ($B_2O_3$), and aluminum oxide ($Al_2O_3$);

a step of adding a binder to the mixture;

a step of granulating the mixture with the binder;

a step of molding the granules into a cylindrical body;

a step of presintering the cylindrical mold body at a temperature between 1,000~1,300° C. for a predetermined time;

a step of coating a paste formed of lithium carbonate ($Li_2CO_3$), silicon oxide ($SiO_2$), antimony oxide ($Sb_2O_3$), and bismuth oxide ($Bi_2O_3$) to the side surface of the cylindrical sintered body, the amount of $SiO_2$, $Sb_2O_3$, and $Bi_2O_3$ being within the region surrounded by the following four composite points in a ternary system diagram of $SiO_2$, $Sb_2O_3$ and $Bi_2O_3$: ($SiO_2$=95 mol %, $Sb_2O_3$=5 mol %, $Bi_2O_3$=0 mol %), ($SiO_2$=50 mol %, $Sb_2O_3$=50 mol %, $Bi_2O_3$=0 mol %), ($SiO_2$=50 mol %, $Sb_2O_3$=30 mol %, $Bi_2O_3$=20 mol %) and ($SiO_2$=75 mol %, $Sb_2O_3$=5 mol %, $Bi_2O_3$=20 mol %), and the amount of $Li_2CO_3$ being from 0.1 to 10 mol %;

a step of baking the paste to the side surface of the cylindrical sintered body at a temperature between 1000–1300° C. for a predetermined time for forming a high resistance side layer for the cylindrical sintered body; and a step of forming electrodes on the upper and lower ends of the cylindrical sintered body.

4. A method according to claim 3 wherein the amount of the paste constituent being 72±5 mol % for $SiO_2$, 20±3 mol % for $Sb_2O_3$, 8±2 mol % for $Bi_2O_3$ and 1~2.5 mol % for $Li_2CO_3$.

5. A method according to claim 3 wherein the temperature of the baking step is higher than that of the presintering step.

* * * * *